United States Patent [19]

Emanuelsson

[11] 4,070,166

[45] Jan. 24, 1978

[54] METHOD AND DEVICE FOR DRIVING LIQUID FROM A LIQUID SEPARATOR

[75] Inventor: Kaj Bengt Ingemar Emanuelsson, Wilrijk, Belgium

[73] Assignee: Atlas Copco Aktiebolag, Nacka, Sweden

[21] Appl. No.: 648,053

[22] Filed: Jan. 12, 1976

[30] Foreign Application Priority Data

Jan. 24, 1975 Sweden ..... 7500808

[51] Int. Cl.[2] ..... B01D 19/00

[52] U.S. Cl. ..... 55/41; 55/185; 55/204; 417/204; 418/97; 418/84;97

[58] Field of Search ..... 55/41, 184, 185, 204; 417/204, 438

[56] References Cited

U.S. PATENT DOCUMENTS

| | | | |
|---|---|---|---|
| 2,701,684 | 2/1955 | Hirsch | 418/84 |
| 3,191,854 | 6/1965 | Lowler et al. | 418/97 |
| 3,482,768 | 12/1969 | Cirrincione et al. | 417/438 X |
| 3,499,270 | 3/1970 | Paugh | 55/459 R |
| 3,917,474 | 11/1975 | Heckenkamp et al. | 55/185 X |

*Primary Examiner*—Frank A. Spear, Jr.
*Assistant Examiner*—Richard W. Burks
*Attorney, Agent, or Firm*—Eric Y. Munson

[57] ABSTRACT

A method and a device for draining liquid from a secondary separator of a compressor plant is disclosed. The liquid is driven by the pressure in the separator to the liquid to be injected into the compressor and is together with the injection liquid driven into the compressor.

7 Claims, 1 Drawing Figure

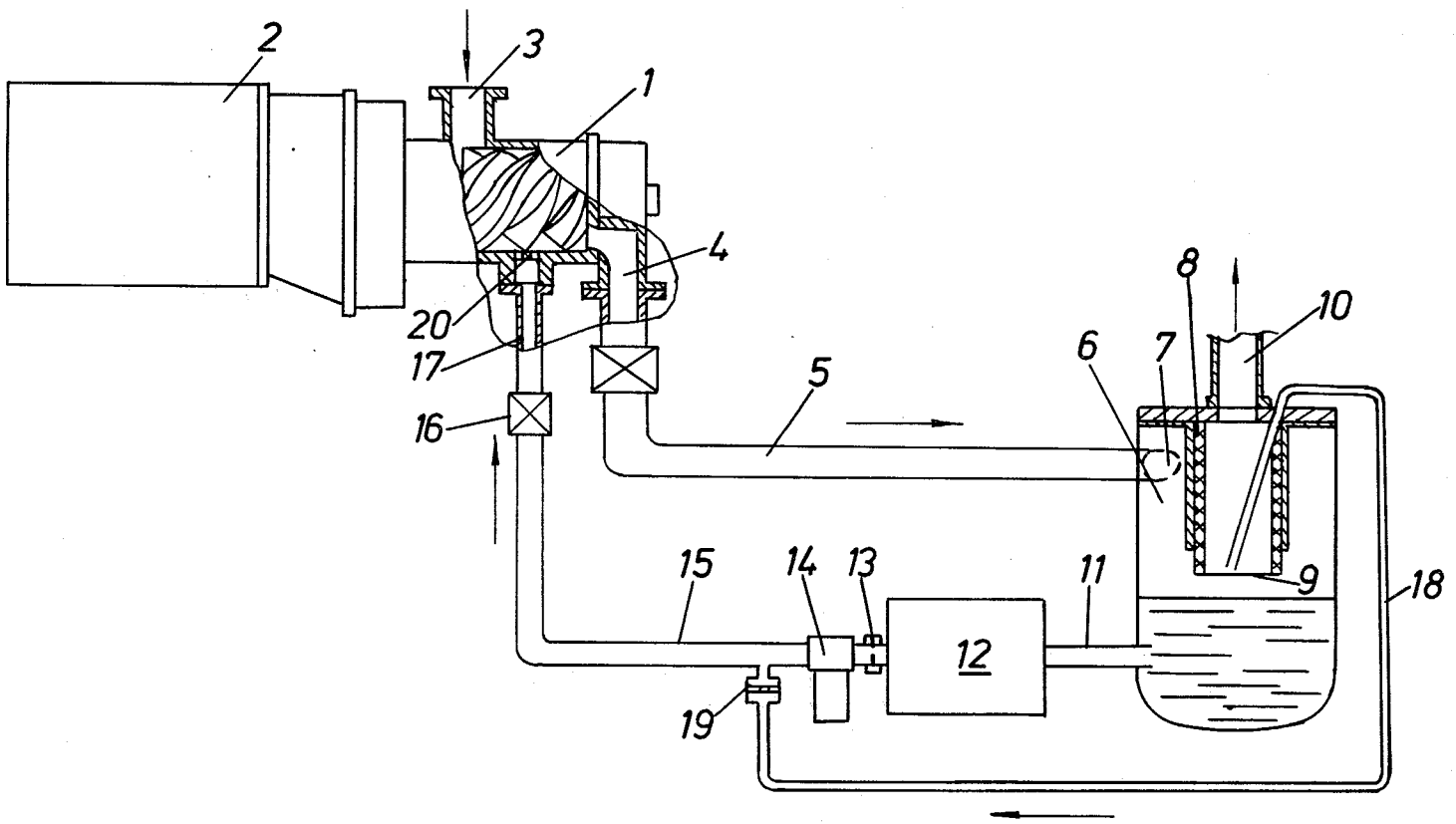
1
2
3
4
5
6
7
8
9
10
11
12
13
14
15
16
17
18
19
20

METHOD AND DEVICE FOR DRIVING LIQUID FROM A LIQUID SEPARATOR

BACKGROUND OF THE INVENTION

The present invention relates to a method and a device for draining liquid from a secondary separator connected to the high pressure end of a liquid injected compressor.

In a prior known embodiment involving of such separation, the liquid is driven from the bottom of the secondary separator by the pressure in the separator through a drainage conduit directly to the inlet opening of the compressor. During operation of the compressor, the amount of liquid which is to be drained sometimes is small, which causes a comparatively large gas flow in the drainage conduit. Since this gas flow is reexpanded to the inlet pressure of the compressor, the efficiency of the compressor is decreased because the energy used to compress the gas cannot be utilized by the compressor. Furthermore, the gas volume increases considerably during its reexpansion, resulting in a considerable decrease of the amount of fresh gas supplied to the compressor during the suction phase. A further disadvantage is that when the compressor is not operating the liquid is driven into the compressor. Thus, when the compressor is restarted, a certain amount of liquid remains in the compression chamber, which may cause starting problems, particularly at low temperatures when the viscosity of the liquid is high.

SUMMARY OF THE INVENTION

According to the present invention the liquid is driven from the secondary separator by the pressure therein to a conduit which conducts liquid from a injection liquid container to the compressor and is mixed with and becomes part of this liquid. The gas flow which is created in the drainage conduit when the amount of liquid to be drained is small is thereby considerably decreased, since the gas flow must pass through the injection liquid in order to reach the compressor.

In a preferred embodiment of the invention, the mixed liquid flow is injected into the compressor in a region where compression has started. In this way the advantage is obtained that the gas flow is reexpanded to a pressure which is higher than the inlet pressure whereby the efficiency is improved and the throttling action required in the drainage conduit in order to obtain a suitable liquid flow can be made with less force with resultant decreased risk of clogging.

If the drainage flow is mixed with the liquid intended for injection ahead of an oil stop value situated in the conduit the further advantage is obtained, when the compressor is stopped, that this drainage liquid will not be injected into the compressor.

BRIEF DESCRIPTION OF THE DRAWINGS

An embodiment of the invention is described below with reference to the accompanying drawing which schematically shows a compressor plant.

DESCRIPTION OF A PREFERRED EMBODIMENT

The compressor plant shown comprises a compressor 1, for example a screw compressor, which is driven by a motor 2. The compressor, which is of the liquid injected type, is provided with an inlet 3 and an outlet 4. The compressed gas is conducted from the outlet via a conduit 5 to a container 6. As shown at 7 the gas is introduced eccentrically into the container, whereby the gas is subjected to a whirling action in the container. Hereby, 90% or more of the liquid acccompanying the gas is separated. The container 6, therefore, constitutes a primary separator. The separated liquid is collected on the bottom of the container. A filter 8, which functions as a secondary separator and is provided with a bottom 9, is mounted in the upper part of the container 6. The compressed gas is conducted through the filter 8 to a delivery conduit 10. During the passage of the compressed gas through the filter, practically all the remaining amount of liquid is separated while at the same time some drop in the gas pressure occurs.

In compressors of the liquid injected type, liquid, usually oil, is injected into the compression chamber in order to lubricate the compressor and to provide a seal. The liquid is forced by the pressure in the container 6 from the bottom thereof through a conduit 11, a cooler 12, a restriction 13, a filter 14, a conduit 15, a shut-off valve or a so-called oil stop valve, 16, a conduit 17 and injection holes 20 into a compression chamber in the compressor where the pressure is considerably higher than at the inlet 3 thereof. The restriction 13 is dimensioned so that a suitable liquid flow is obtained. Since the pressure within the interior of the secondary separator 8 is lower than exteriorly thereof the liquid separated by the secondary separator cannot drain to the bottom of the container 6 without the aid of a pump. The liquid collected on the bottom 9 is forced by the pressure in the secondary separator 8 through a conduit 18 and a restriction 19 into the conduit 15 where this drainage stream is mixed with the primary injection liquid. The restriction 19 adjusts the pressure in the drainage flow to the pressure in the conduit 15.

The shut-off valve 16 serves the purpose of interrupting the liquid injection when the compressor is stopped in order to prevent the compressor from becoming filled with liquid. The valve automatically shuts, when the compressor is stopped for example by means of electric control or by means of gas pressure control.

The above described and in the drawing shown embodiment of the invention is only to be regarded as an example which can be modified within the scope of the subsequent claims.

What I claim is:

1. The method of separating the liquid phase from the mixture of compressed gas and liquid and returning the separated liquid phase to the compressor in a liquid injected system, said method comprising:

a. passing a stream of the compressed gas and liquid mixture from the compressor into a closed container;

b. subjecting said mixture to a primary separation step in said container, whereby a major portion of the liquid phase is separated off and collected at the bottom of the container and maintained under the pressure prevailing thereon, passing a stream of the thus separated liquid as primary injection liquid from said container through a primary passage to the compressor by the pressure prevailing in the container;

c. subjecting the partly separated mixture to a secondary separating zone within said container, from which the liquid-freed compressed gas is discharged while the separated-off liquid is collected under the prevailing pressure in said secondary separating zone at a location spaced from the liquid level in said container;

d. passing the stream of the liquid collected in said secondary separating step by the pressure prevailing in said secondary separating zone in a passage merging with said primary passage and injecting the merged liquid streams under controlled force into the compressor through a common passage.

2. The method according to claim 1, in which the common passage passes the merged streams into the compressor at a point where compression has commenced;

3. The method according to claim 2, in which the mixture is subjected to a whirling action in the primary separating step.

4. In a liquid injected compression system, a. a compressor;

b. a closed container-separator;

c. first passage means for passing a mixture of compressed gas and liquid into said container separator;

d. primary separator means in said container for separating off liquid from said mixture and causing the separated liquid to collect at the bottom of the container while maintained under pressure of the compressed medium;

e. secondary separator means surrounded by said primary separator means providing a passage for the primarily separated mixture in a secondary separating step and allowing the liquid-freed compressed gas to be discharged therefrom;

f. means for collecting the liquid separated off in said secondary separation step while maintained under the pressure prevailing therein;

g. second passage means for passing a stream of liquid from the bottom of said container by the pressure prevaliing therein to said compressor;

h. third passage means for passing a stream of liquid collected in said secondary separating step;

i. said third passage means merging with said second passage means to provide a common injection passage to the compressor.

5. A liquid injected compressor system according to claim 4, including means for regulating the differential pressure between the liquid streams.

6. A liquid injected compressor system according to claim 4 in which the said common passage injects the merged streams into the compressor at a point where the compression has commenced.

7. A liquid injected compressor system according to claim 4, in which said common passage includes a controlled shut-off valve for interrupting the injection of liquid into the compressor upon stoppage of the compressor operation.

* * * * *